US005938355A

United States Patent [19]

Suzuki

[11] Patent Number: 5,938,355

[45] Date of Patent: Aug. 17, 1999

[54] SHEET FEEDER AND PRINTER FITTED WITH SHEET FEEDER

[75] Inventor: Hiroshi Suzuki, Anjou, Japan

[73] Assignee: Brother Kogyo Kabushiki Kaisha, Nagoya, Japan

[21] Appl. No.: 08/947,314

[22] Filed: Oct. 8, 1997

[30] Foreign Application Priority Data

| | | | |
|---|---|---|---|
| Oct. 14, 1996 | [JP] | Japan | 8-271076 |
| Oct. 15, 1996 | [JP] | Japan | 8-272093 |
| Oct. 15, 1996 | [JP] | Japan | 8-272096 |

[51] Int. Cl.[6] ..... B41J 13/10

[52] U.S. Cl. ..... 400/624; 271/121; 400/629

[58] Field of Search ..... 400/624, 625, 400/629; 271/37, 109, 119, 121, 127, 160, 167, 171

[56] References Cited

U.S. PATENT DOCUMENTS

| | | | |
|---|---|---|---|
| 4,815,724 | 3/1989 | Sumida et al. | 271/121 |
| 4,995,601 | 2/1991 | Ohashi et al. | 271/127 |
| 5,026,042 | 6/1991 | Miller | 271/119 |
| 5,348,283 | 9/1994 | Yanagi et al. | 271/127 |
| 5,427,462 | 6/1995 | Jackson et al. | 400/624 |
| 5,480,247 | 1/1996 | Saikawa et al. | 400/629 |
| 5,506,606 | 4/1996 | Saikawa et al. | 400/624 |
| 5,540,423 | 7/1996 | Nakano | 271/119 |
| 5,615,874 | 4/1997 | Parthasarathy et al. | 271/121 |
| 5,725,319 | 3/1998 | Saito et al. | 400/629 |

FOREIGN PATENT DOCUMENTS

| | | | |
|---|---|---|---|
| A-63-112333 | 5/1988 | Japan . | |
| A-1-176734 | 7/1989 | Japan . | |
| A-5-32329 | 2/1993 | Japan . | |
| 5-221062 | 8/1993 | Japan | 400/624 |

OTHER PUBLICATIONS

IBM Technical Disclosure Bulletin, vol. 31, No. 10., "Cut–Sheet Paper Tray Spring Compesates . . . " Mar. 1989.

*Primary Examiner*—Christopher A. Bennett
*Attorney, Agent, or Firm*—Oliff & Berridge, PLC

[57] ABSTRACT

A sheet feeder includes a sheet support, on which sheets of paper can be stacked with their front ends aligned on the bottom surface of the support. The feeder also includes two feed rollers for feeding one by one the sheets stacked on the support. An inclined surface extends downstream in the feeding direction from the front end of the bottom surface of the support, and inclines downstream with respect to the bottom surface. The rollers are positioned out of symmetry with respect to the width of the bottom surface. A side end portion of the inclined surface which is far from the rollers is less resistant to sheets of paper than the portions of this surface which face the rollers. Even a wide sheet can be fed without inclining with respect to the feeding direction.

41 Claims, 9 Drawing Sheets

SHEET FEEDER AND PRINTER FITTED WITH SHEET FEEDER

BACKGROUND OF THE INVENTION

1. Field of the Invention

The present invention relates to a sheet feeder for feeding stacked sheets of paper one by one, and to a printer fitted with such a feeder.

2. Description of the Related Art

In some conventional sheet feeders, sheets of paper of various widths can be set selectively. Such a sheet feeder, where different sheets of paper are used, includes two feed rollers positioned in accordance with the width of the sheets for the most frequent use, which may be the sheets of the A4 size. An envelope for sheets of the A4 size is larger than them. When this envelope is placed in a sheet feeder with two feed rollers positioned for the A4 size, part of the envelope protrudes outside one of the rollers. In general, in order to separate one by one the envelopes or the sheets with some rigidity which are stacked in a sheet feeder, the top envelope or sheet is curved over a slope. When the envelope part outside the roller crosses the slope, this part makes high resistance against a surface of the sheet feeder, which may incline the envelope being fed with respect to a feeding direction. An envelope is made of a folded or doubled, relatively rigid sheet of paper. If one or both of the right and left edges of an envelope are bent or warped toward the surface of the sheet feeder, they are more rigid and make higher resistance.

A sheet feeder of a certain type includes a right sheet guide and a left sheet guide, which are interlocked with feed rollers. The rollers shift when the guides are shifted in accordance with the sheet width. In this case, also, the right and left edges of the sheets cannot be prevented from making resistance to the surface of the sheet feeder. Since this type of feeder needs a complicated mechanism for shifting the rollers and the guides depending on the sheet width, it is costly for manufacturing.

A sheet feeder of other type has more than four or five feed rollers provided coaxially on a common axis in order to conform to various size of sheet. This type of feeder also needs many components and much production cost.

SUMMARY OF THE INVENTION

It is a first object of the present invention to provide a sheet feeder which can feed relatively rigid sheets of paper without inclining them with respect to a feeding direction, and to provide a printer including such a feeder.

It is a second object of the invention to provide a sheet feeder of simple structure with which sheets of paper of different widths can be used, and to provide a printer including such a feeder.

It is a third object of the invention to provide a sheet feeder which can feed sheets of paper of various widths without inclining them with respect to the feeding direction, and to provide a printer including such a feeder.

It is a fourth object of the invention to provide a sheet feeder of simple structure which can feed sheets of paper of different widths accurately to a print unit, and to provide a printer including such a feeder.

In accordance with a first aspect of the invention, a sheet feeder is provided, which includes a sheet support and a feed roller. Sheets of paper can be stacked on the support with their front ends (leading edges) aligned on the bottom surface of the support. The roller can feed one by one the sheets stacked on the support. An inclined surface extends from the front end of the bottom surface of the support downstream in the feeding direction. The inclined surface inclines downstream with respect to the bottom surface. The inclined surface has both side end portions, which extend in the feeding direction. At least one of the end portions is less resistant to the sheets than the portion of the inclined surface which faces the roller.

The front end of a sheet of paper being separated and sent from the sheet support by the feed roller leaves the bottom surface (sheet bearing surface) of the support. Thereafter, the sheet end is sent downstream along the inclined surface, which is connected to the bottom surface. Because a front end portion of the sheet curves over the inclined surface, the sheet can easily separate from the other sheets. As stated above, at least one of the side end portions of the inclined surface is less resistant to the sheets than the portion of the inclined surface which faces the roller. Therefore, even if the adjacent side edge or both side edges of a sheet are bent or warped, the sheet can pass the inclined surface without being caught by the less resistant side end portion/s of the inclined surface.

The feed roller may be positioned out of symmetry widthwise of the sheets stacked on the sheet support. One of the side end portion of the inclined surface may be farther from the roller than the other. Particularly in this case, the feeding force of the roller is smaller in the farther end portion. Therefore, the side edge of a sheet (for example, a sheet set sideways or a sheet of a large size) which passes this end portion is liable to be caught by the inclined surface. However, the farther end portion is less resistant to sheets of paper than the portion of the inclined surface which faces the roller. Therefore, the inclined surface is prevented from catching the sheet edge.

The feed roller may include at least two rollers. Both of the farther and nearer side end portions of the inclined surface may be less resistant to the sheets than the portions of this surface which face the rollers. In this case, even if the side edge of a sheet which passes the nearer end portion of the inclined surface is bent or warped, the resistance to the sheet edge can be reduced to send the sheet smoothly. By making the farther portion larger in area than the nearer portion, it is possible to adjust the resistance difference between the less resistant portions.

It is possible to lower the resistance of the inclined surface partially by fitting one or more smooth films partially on this surface, or forming one or more recesses partially in the surface. A recess may extend over each portion which should be low in resistance to sheets of paper. A plurality of small recesses may be dispersed over the portion. The sheet support may include a reference guide for contacting and registering the adjacent side edges of the sheets stacked on the support. The feed roller/s may be offset toward the reference guide widthwise of the sheets in consideration of the size/s of sheets for frequent use. In case of using the two feed rollers, the middle position between them may be offset toward the reference guide with respect to the width of the support. Side edges of various sheets with different widths are registered by contacting the guide. When wide or large sheets are stacked on the support, it is effective that the portion of the inclined surface which will be faced by the side edge of the sheets which is opposite to the guide is less resistant than the portion/s of the inclined surface which faces/face the roller/s.

In accordance with a second aspect of the invention, another sheet feeder is provided, which includes a sheet support and a feed roller. The feed roller can feed one by one the sheets of paper stacked on the support, which urges the sheets toward the feed roller. A friction member is fixed to the portion of the support which faces the feed roller. A reference guide can contact and register the adjacent side edge of the stacked sheets. An auxiliary roller is supported coaxially with and spaced from the feed roller, which is positioned between the auxiliary roller and the guide. The friction member is higher than the portion of the surface of the support which faces the auxiliary roller.

The principle of the feeder according to the second aspect will be explained separately in two cases wherein narrower and wider sheets of paper are fed respectively.

When narrower sheets, which may be sheets of the B5 size narrower than sheets for frequent use for business, are stacked on the sheet support and registered by the reference guide, the sheets face only the feed roller, and does not face the auxiliary roller. The sheets can therefore be sent from the support by the feed roller only. When the sheets stacked on the support are small in number, the bottom sheet is constrained onto the support by the friction member under the feed roller. This prevents the sheets from being sent one upon another by the feed roller. The friction member is higher than the portion of the surface of the support which faces the auxiliary roller. Therefore, even if the sheets are small in number, the feeding by the feed roller is not hindered by idling of the auxiliary roller and not interfering with the support.

When wider sheets, which may be sheets of the A4 size or the legal size for frequent use for business, are stacked on the sheet support and registered by the reference guide, the sheets face the feed roller, while side edges of them face the auxiliary roller substantially. Therefore, not only the feed roller but also the auxiliary roller can apply sending force to sheets of this or larger sizes, which can be sent without inclining with respect to the sending direction. When the sheets stacked on the support are small in number, they can be sent mainly by the feed roller. The friction member constrains the bottom sheet onto the support as effectively as in case of narrower sheets. When an envelope for sheets for business is set on the support, the auxiliary roller faces a longitudinal end portion of the envelope, which can therefore be sent excellently or satisfactorily by the feed and auxiliary rollers.

The sheet support of this feeder may have a bottom surface, on which the front ends of the stacked sheets are aligned and held. This feeder may have an inclined surface extending from the front end of the bottom surface of the support downstream in the feeding direction. The inclined surface inclines downstream with respect to the bottom surface. The inclined surface includes both side end portions which extend in the feeding direction. At least one of the end portions is less resistant to the sheets than the portion of the inclined surface which faces the feed roller. Such structure, even when the wider sheets stacked on the sheet support are small in number, lowers the resistance of the inclined surface to the associated or appropriate side end portions of the sheets. As a result, the sheets can securely be sent without inclining by the feed roller only. In order to disperse the feeding force of the feed roller over the sheet width, this roller may include at least two rollers supported coaxially.

In accordance with a third aspect of the invention, still another sheet feeder is provided, which includes a sheet support for supporting sheets of paper stacked on it. A reference guide is fitted on the support so as to contact and register the adjacent side edges of the sheets stacked on the support. At least two feed rollers like semi-cylindrical feed rollers are supported widthwise of the stacked sheets so as to feed the sheets one by one. The rollers includes a first feed roller and a second feed roller. The second feed roller is farther from the guide and larger in at least one of feeding force and feeding amount than the first feed roller.

This feeder can feed sheets of paper of various widths or sizes. The feed rollers may be positioned in consideration of the widths of sheets for frequent use, which may be sheets of the A4 size or the legal size for business. When sheets wider than these sizes are registered by the reference guide, large portions of the sheets protrude outside the feed roller which is opposite to the guide. The second feed roller, which is farther from the guide, is larger in at least one of feeding force and feeding amount than the first roller, which is nearer to the guide. It is therefore possible to prevent the protruding sheet portions from being inclined by the resistance of the sheet support. On the other hand, sheets for frequent use like A4 size or legal size sheets involve no large protruding portions, which would be resisted. As a result, the sheets are fed faster on the side adjacent to the guide. The inclination of the sheets can, however, be rectified by a registering mechanism positioned downstream. The registering mechanism may include a feeding roller positioned downstream from the feeding rollers. The feeding roller may cooperate with a pressure roller to feed a sheet further downstream. This feeding roller may be driven by a drive which controls the rotation direction of this roller. By holding, at the nip or the vicinity thereof between the pressure roller and the feeding roller turning reversely or stopping, the front end of a sheet sent by the feed rollers, it is possible to register the sheet end. Thus, by using this feeder in combination with the registering mechanism, it is possible to make the feeder simple in structure and the parts small in number, as compared with sheet feeders where guides, rollers and/or the like are manipulated in accordance with the sheet widths.

The second feed roller, which is farther from the reference guide, may be larger in diameter than the first feed roller, which is nearer to the guide. This makes the farther roller larger in both feeding force and feeding amount than the nearer roller. The farther roller may be larger in frictional force and/or axial size to increase its feeding force.

The first aspect and/or second aspect of the invention can be applied to the feeder according to the third aspect. By combining two or all of these aspects, it is possible to feed a sheet of paper even more securely without inclining the front end of the sheet, even if one or both side end portions of the sheet are bent or warped, or even if the sheet is wider than a predetermined width.

In accordance with a fourth aspect of the invention, a printer is provided, which includes a sheet support and a feed roller. Sheets of paper can be stacked on the support with their front ends aligned on the bottom surface of the support. The roller can feed one by one the sheets stacked on the support. An inclined surface extends from the front end of the bottom surface of the support downstream in the feeding direction. The inclined surface inclines downstream with respect to the bottom surface. The inclined surface includes both side end portions which extend in the feeding direction. At least one of the end portions is less resistant to the sheets than the portion of the inclined surface which faces the roller. The printer also includes a print head positioned downstream from the inclined surface.

In accordance with a fifth aspect of the invention, another printer is provided, which includes a sheet support and a feed roller. The feed roller can feed one by one the sheets of paper stacked on the support, which urges the sheets toward the feed roller. A friction member is fixed to the portion of the support which faces the feed roller. A reference guide can contact and register the adjacent side edges of the stacked sheets. An auxiliary roller is supported coaxially with and spaced from the feed roller, which is positioned between the auxiliary roller and the guide. The friction member is higher than the portion of the surface of the support which faces the auxiliary roller. A print head is positioned downstream from the feed roller.

In accordance with a sixth aspect of the invention, still another printer is provided, which includes a sheet support for supporting sheets of paper stacked on it. A reference guide is fitted on the support so as to contact and register the adjacent side edges of the sheets stacked on the support. At least two feed rollers are supported widthwise of the stacked sheets so as to feed the sheets one by one. The rollers include a first feed roller and a second feed roller. The second feed roller is farther from the guide and larger in at least one of feeding force and feeding amount than the first. A print head is positioned downstream from the rollers.

Sheets of various widths can, without inclining with respect to the feeding direction, be fed to the print head of each of the printers according to the fourth, fifth and sixth aspects. Therefore, the printers can accurately print sheets of any sizes.

BRIEF DESCRIPTION OF THE DRAWINGS

Preferred embodiments of the present invention are shown in the accompanying drawings, in which.

DETAILED DESCRIPTION OF PREFERRED EMBODIMENTS

Figure 1:
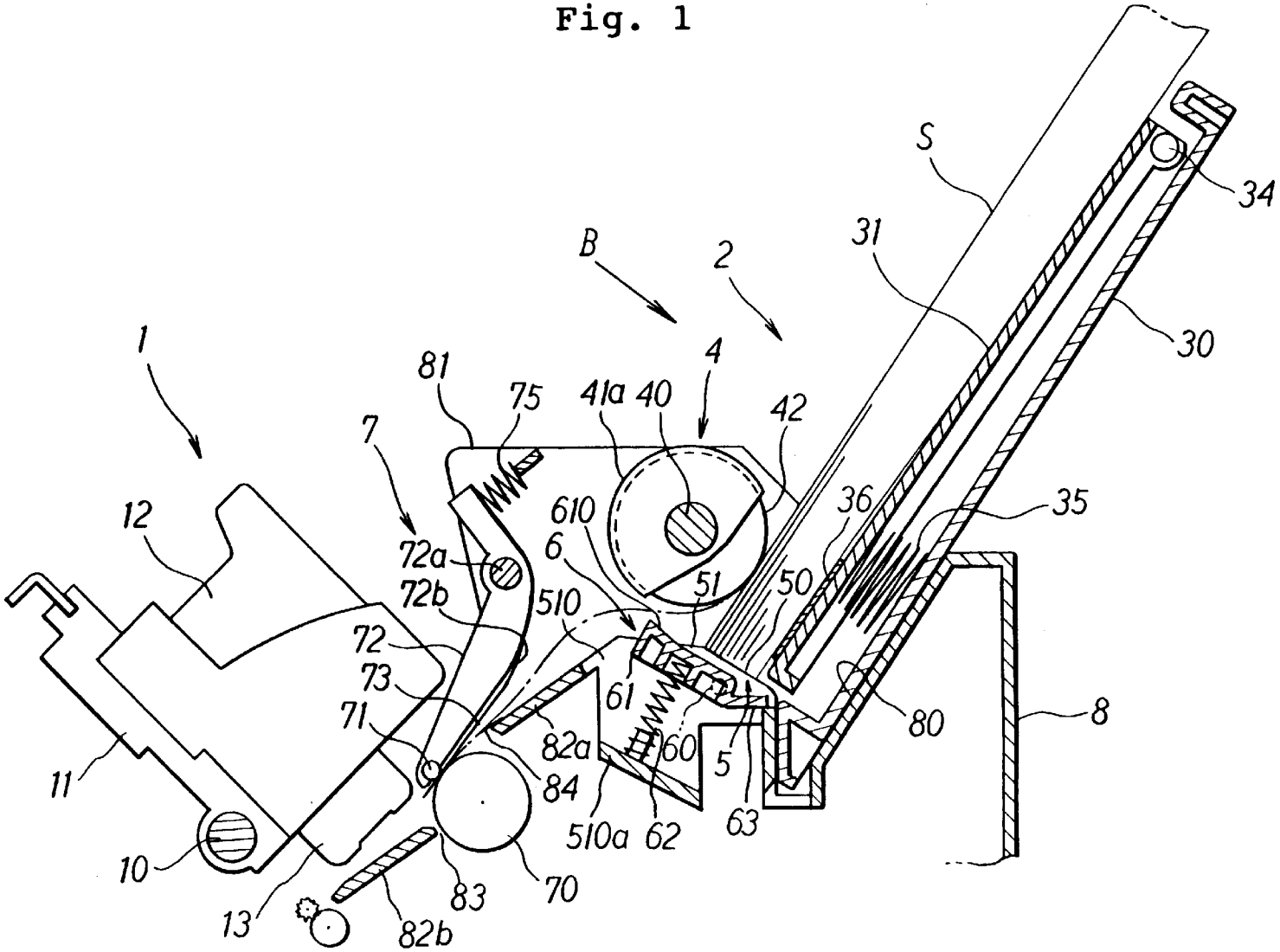
FIG. 1 is a partial cross section of an ink jet printer according to one of the embodiments.

With reference to FIG. 1, an ink jet printer includes a print unit 1, which includes a print head 13 for printing a sheet of paper. A sheet feeder 2 can feed sheets of paper S one by one to a place under the head 13. The sheets S are rectangular cutforms of a certain size. The printer also includes a frame 8, on which a pair of side walls 81 stand.

The print unit 1 also includes a carriage 11 supported slidably on a horizontal guide rail 10, which is fixed to the side walls 81. The rail 10 extends widthwise of the sheets S fed from the feeder 2. In other words, the rail 10 extends in parallel with the surfaces of the sheets S and perpendicularly to the direction in which the sheets S are fed. The carriage 11 carries an ink cartridge 12 and the print head 13. While the carriage 11 is reciprocated along the rail 10 by a drive (not shown), the head 13 can eject ink droplets onto a sheet of paper S positioned under it. This can print the sheet S with an image, which may include characters, graphics and/or figures, in the form of a dot matrix.

The feeder 2 includes a rectangular sheet hopper or cassette 30, in which sheets of paper S can be stacked. The sheets S in the hopper 30 can be sent one by one by a sheet sender 4. The feeder 2 also includes a wall 5, where a stop mechanism 6 is fitted. The front end of a sheet S sent from the hopper 3 comes into contact with the wall 5. A sheet conveyer 7 is positioned downstream from the wall 5 and upstream from the print unit 1.

The frame 8 has a hopper support recess 80. The hopper 30 is supported by the recess 80 obliquely with its front side downward and its front and rear sides horizontal. Positioned in the hopper 30 is a sheet support 31, on which sheets of paper S can be stacked. The support 31 is supported at its rear end pivotably through a shaft 34 by the rear end of the hopper 30. The shaft 34 is parallel to the guide rail 10 of the print unit 1. The front end of the support 31 is urged toward the sender 4 by springs 35 as a guide member.

Figure 2:
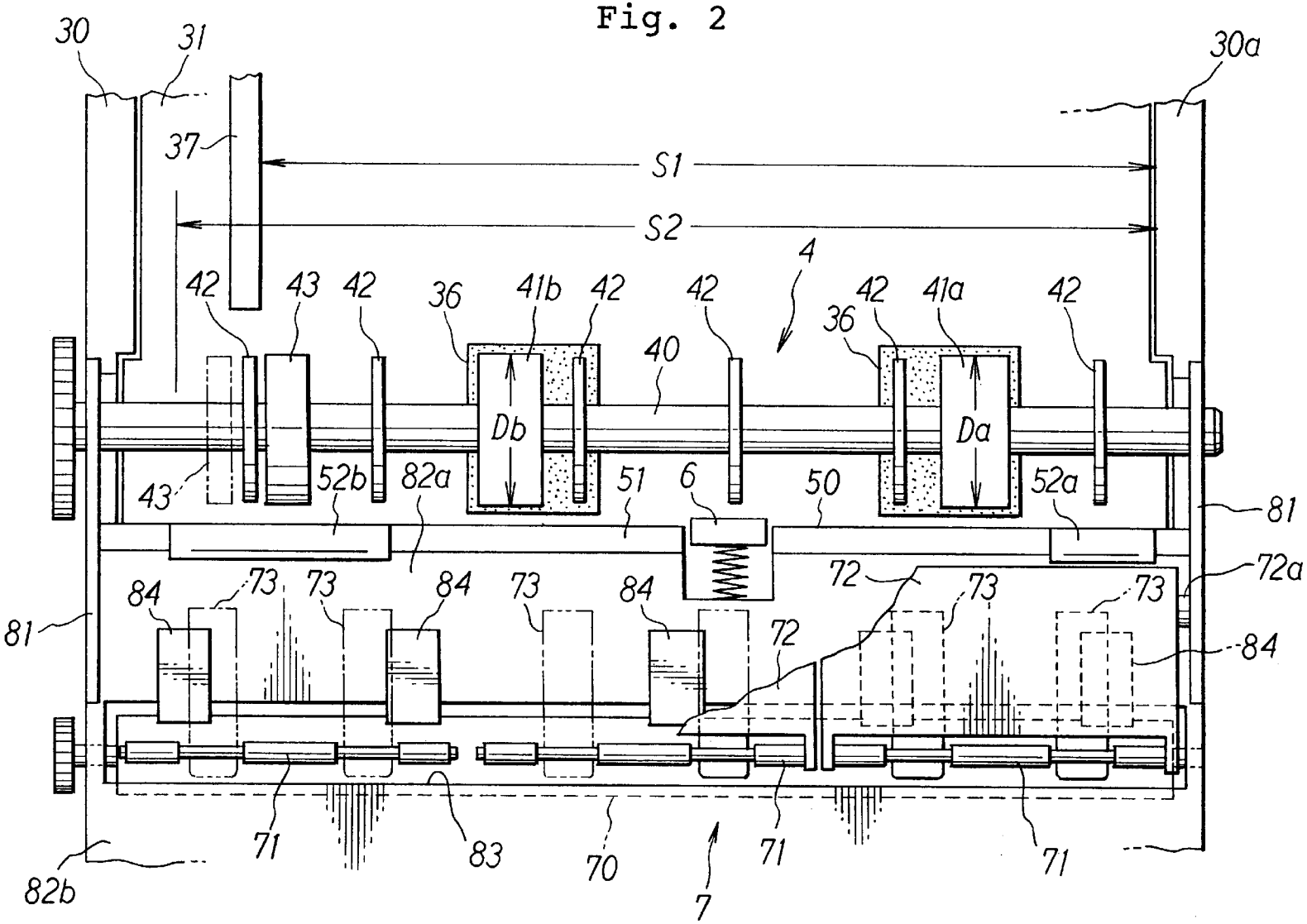
FIG. 2 is a partial view taken in the direction of arrow B of FIG. 1, but without sheets of paper.

As shown in FIGS. 1 and 2, the support 31 is fitted with friction members 36 on its upper surface. The members 36 can constrain onto the support 31 the bottom one of the sheets S stacked on the support 31. This prevents all of the sheets S from being sent one upon another from the support 31 when the number of sheets S is small (for example, two or three). The friction members 36 may be made of cork. The members 36 are higher than the upper surface of the support 31. Each member 36 is positioned under one of two main feed rollers 41*a* and 41*b*, which will be described later. The members 36 might, however, be positioned between or near the rollers 41*a* and 41*b*, or in other positions along the common axis of the rollers 41*a* and 41*b*. The springs 35 are positioned to be opposite to the rollers 41*a* and 41*b* respectively.

The hopper 30 includes a pair of side walls. The left (right in FIG. 2) side wall 30*a* functions as a reference guide for positioning and guiding the adjacent edges of the sheets S. The hopper 30 is fitted with a movable guide 37 on it for positioning and guiding the other edges of the sheets S in such a manner that the guide 37 can slide widthwise of the sheets S.

The sender 4 includes a shaft 40 supported at both its ends rotatably by the printer walls 81. The shaft 40 is parallel to the sheet support shaft 34. The shaft 40 can be rotated by a drive (not shown) clockwise in FIG. 1. The shaft 40 supports the main feed rollers 41*a* and 41*b*, an auxiliary feed roller 43 and six collars 42 coaxially at intervals.

The main feed rollers 41*a* and 41*b* are fixed to the shaft 40, and made of rubber. The rollers 41*a* and 41*b* are semi-cylindrical, and each have a cylindrical surface 410 (FIG. 4 etc.), which is coaxial with the shaft 40. The surface 410 is circumferentially long enough to send a sheet of paper S to the nips each between the cylindrical feed roller 70 and one of the guide strips 73, which will be described later, of the conveyer 7.

The diameter Da of the cylindrical surface of the main feed roller 41*a* adjacent to the reference guide 30*a* is smaller slightly than the diameter Db of the cylindrical surface of the other main roller 41*b*. In this embodiment, Db=1.025×Da. It is preferable that the difference in diameter be within such a range that the top one of the sheets stacked on the support 31 can contact the rollers 41*a* and 41*b* through the elastic deformation of the support and of the rubber of which the rollers are made, etc.

The auxiliary feed roller 43 is fixed to the shaft 40, and has the same shape as the main feed rollers 41*a* and 41*b* have, but is smaller axially than them.

Figure 7:
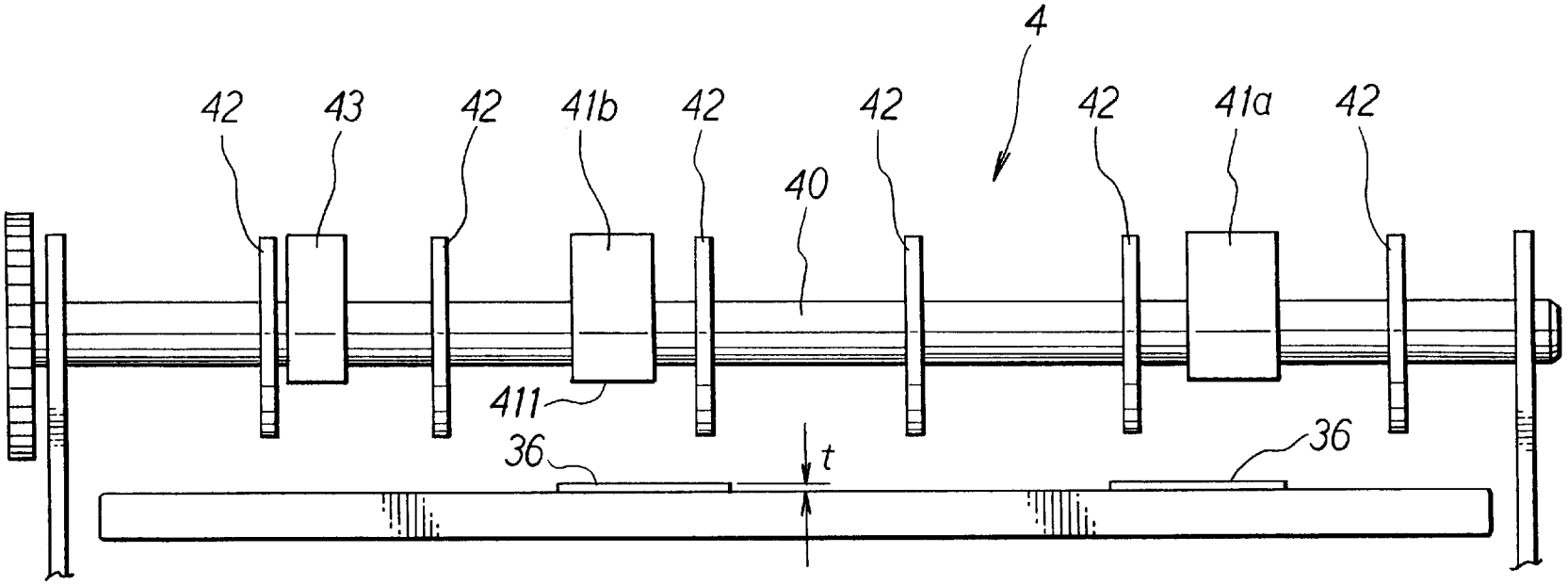
FIG. 7 is a partial front end view of the sheet feeder of the printer, showing the relationship between the sheet sender and sheet support.

As shown in FIG. 7, the leading and trailing ends of the cylindrical surfaces of the rollers 41*a,* 41*b* and 43 are aligned axially.

Figure 4:
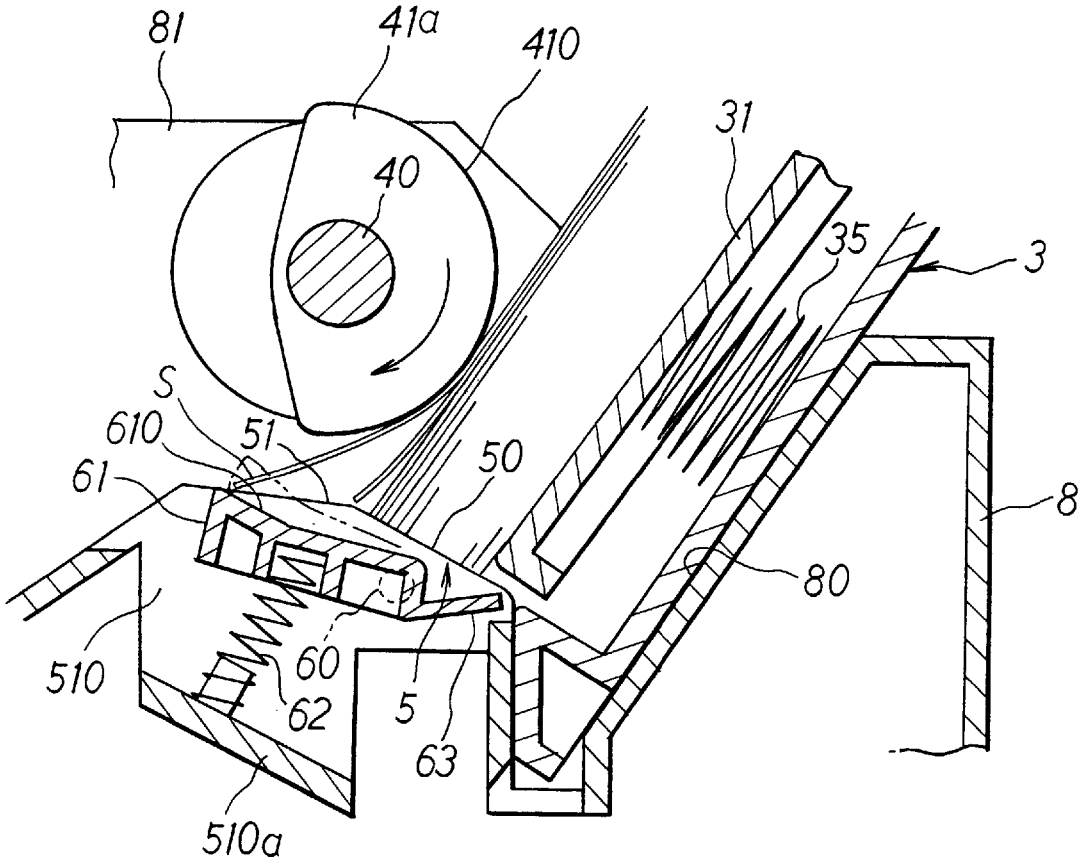
FIG. 4 is another enlarged partial cross section of the printer, showing a sheet of higher rigidity being separated.

The collars 42 are annular and each have an outer peripheral surface of constant curvature. The collars 42 can rotate relative to the shaft 40. As shown in FIG. 4 etc., the peripheral surfaces of the collars 42 are smaller slightly in diameter than the cylindrical surfaces of the semi-cylindrical feed rollers 41*a,* 41*b* and 43.

When the main feed rollers 41*a* and 41*b* turn with the shaft 40 clockwise in FIG. 1 from their initial position shown in FIG. 1, their cylindrical surfaces 410 come into compressive contact with the top one of the sheets S stacked on the support 31. Further turning of the rollers 41*a* and 41*b* sends part of the top sheet S out of the hopper 30. When the cylindrical surfaces 410 have turned away from the hopper 30, the part of this sheet S which remains in the hopper 30 comes into contact with the peripheral surfaces of the collars 42. Consequently, the cylindrical surfaces 410 of the rollers 41*a* and 41*b* are kept away from the sheets S. In the meantime, the conveyer 7 conveys the partially sent sheet S. The collars 42 turn by following the sheet being conveyed. Until the next sheet S starts to be sent, the sheets S remaining in the hopper 30 are kept from floating or swelling.

As shown in FIG. 2, the main feed rollers 41*a* and 41*b* are positioned at an interval to apply sending or feeding force in lateral balance to sheets of paper of the standard sizes for business when the sheets are stacked on the support 31. For the stacked sheets of the A4 or English letter size S1, each of the rollers 41*a* and 41*b* is located at a predetermined distance inside the adjacent side edges of the sheets. For the stacked sheets of the B5 size and the stacked post cards, the rollers 41*a* and 41*b* are spaced from each other in such a manner that both of them are in contact with the top one of the sheets or cards.

The auxiliary feed roller 43 is positioned between the side edge of the support 31 which is opposite to the reference guide 30*a* and the main feed roller 41*b*. The auxiliary roller 43 is spaced from the main roller 41*b*. When an envelope of the size S2 (FIG. 2) for sheets of the size S1 is placed on the support 31, the auxiliary roller 43 is located at a predetermined distance inside the side edge of the envelope which is away from the reference guide 30*a*. This roller 43 is aligned nearly with those side edges of the sheets of the size S1 which are away from the guide 30*a*.

The collars 42 are positioned at predetermined intervals over the width of the support 31, that is, the width of an envelope or another sheet wider than the size S1.

In accordance with the size, the rigidity and/or the like of envelopes, another auxiliary feed roller 43 might be added as shown by two-dot chain lines in FIG. 2, and the roller/s 43 might be equal to or larger than the main rollers 41*a* and 41*b* in axial size. The auxiliary roller/s 43 might be smaller slightly in diameter than the main rollers 41*a* and 41*b*. The support 31 is fitted with no friction member/s (36) under the roller/s 43.

Figure 3:
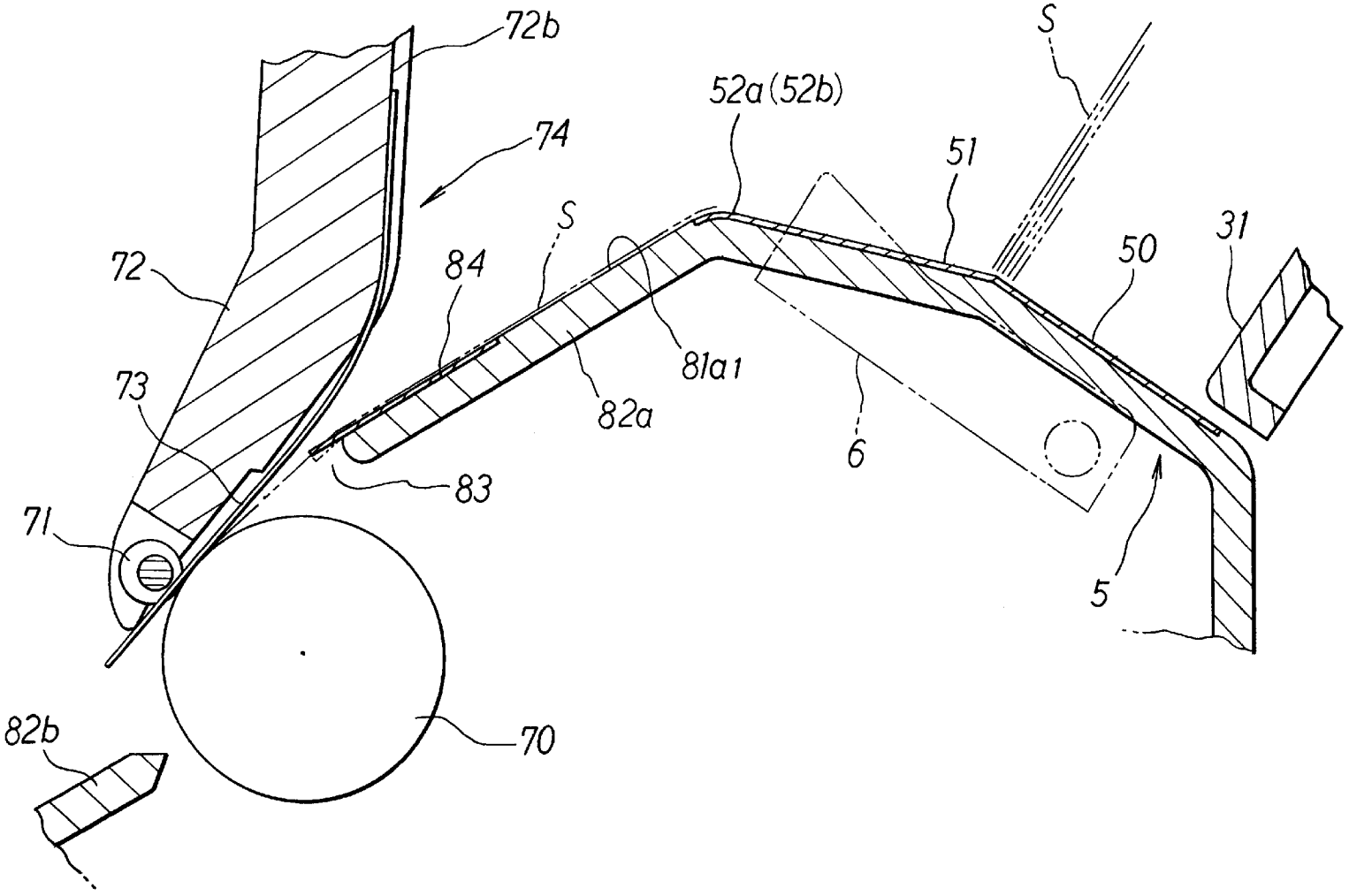
FIG. 3 is an enlarged partial cross section of the printer.

As shown in FIG. 1, the wall 5 of the feeder 2 is positioned at the front end of the hopper support recess 80, and integral with the frame 8. As shown in FIG. 3, the wall 5 has a stop surface 50 for stopping or bearing the front ends of the sheets S stacked on the support 31. The wall 5 also has an inclined surface 51 extending from the front end of the stop surface 50. The inclined surface 51 gradually rises away from the hopper 30. The frame 8 includes a passage wall 82*a* extending from the front end of the inclined surface 51. The frame 8 includes another passage wall 82*b* extending from the front end of the wall 82*a*. Formed along the walls 5, 82*a* and 82*b* is a sheet passage for a sheet S sent from the hopper 30. The passage extends to a position over which the print head 13 can reciprocate.

Figure 6:
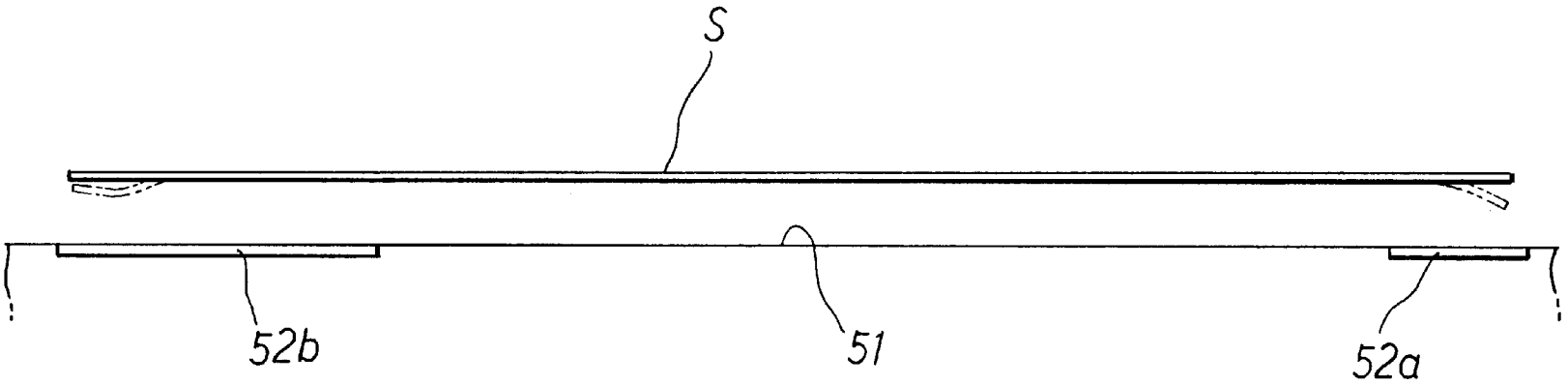
FIG. 6 is a fragmentary front view of the printer, showing the relationship between a sheet of paper and the inclined surface 51 of the printer.

As shown in FIGS. 2 and 3, the wall 5 is fitted with a pair of resin sheets 52*a* and 52*b* near its left and right edges, respectively. These sheets 52*a* and 52*b* each extend over the stop surface 50 and the inclined surface 51, and are stuck to them. The surfaces of the sheets 52*a* and 52*b* are smooth. The friction factors of the resin sheets 52*a* and 52*b* with respect to the paper sheets S are smaller sufficiently than that of the other area of the inclined surface 51. The resin sheet 52*a* is positioned at the edges of the paper sheets S which are adjacent to the reference guide 30*a*. The other sheet 52*b* faces the auxiliary feed roller/s 43. In other words, the resin sheet 52*b* is positioned on the opposite side of the main feed roller 41*b* to the reference guide 30*a*. This sheet 52*b* is wider than the sheet 52*a*. The auxiliary feed roller 43 can move a right end portion of an envelope of the size S2. While this portion is sliding up the inclined surface 51, the resistance to it is reduced by the resin sheet 52*b*. An envelope is made of a folded or doubled thick sheet of paper, and therefore relatively rigid. If, as shown in FIG. 6, one or both of the right and left ends of an envelope are bent or warped down, they are in strong or close contact with the inclined surface 51 and resisted highly while sliding on it. The resin sheets 52*a* and 52*b* reduce the resistance.

The inclined surface 51 has a recess 510 opening upon the sheet passage. The stop mechanism 6 is fitted in the recess 510. The surface 51 might be curved. As shown in FIG. 2, the stop mechanism 6 is positioned in lateral symmetry with respect to the main feed rollers 41*a* and 41*b*. In other words, the stop mechanism 6 is positioned midway between the rollers 41*a* and 41*b*. In place of the single stop mechanism 6, two or more stop mechanisms might be fitted in laterally symmetric positions between the rollers 41*a* and 41*b*. The stop mechanism 6 can apply a load symmetrically on the sending forces of the rollers 41*a* and 41*b*.

The stop mechanism 6 includes a stopper 61 supported pivotably on a pin 60. The pin 60 is parallel to the shaft 40, and positioned upstream from the inclined surface 51. The stopper 61 is urged by a coil spring 62 so that the top surface 610 of its front end portion normally protrudes from the inclined surface 51 toward the hopper 30. Normally, the stopper surface 610 faces the hopper 30 and, as viewed from the hopper 30, inclines at an obtuse angle to the inclined surface 51 so that it can contact a paper sheet S sent from the hopper 30. With respect to the direction in which paper sheets S are sent, the stopper surface 610 is larger in gradient or inclination than the inclined surface 51. The stopper 61 includes a tail 63 extending from its rear end. The tail 63 can contact the top of the rear wall of the recess 510 so as to stop the stopper 61 from protruding further from the inclined surface 51. The stopper 61 is made of resin similar to the resin of which the frame 8 is made. The rigidity of the stopper 61 is high enough to keep the stopper shape constant against the force with which a paper sheet S pushes the stopper surface 610. The force with which the spring 62 urges the stopper 61 is so set that the stopper 61 protrudes from or retracts under the inclined surface 51 in accordance with the rigidity of paper sheets S. This ensures proper separation effect in accordance with the rigidity of paper sheets S.

When the stopper surface 610 is pressed by a post card, an envelope, a thick paper sheet or another relatively rigid paper sheet S, as shown with solid lines in FIG. 4, the stopper 61 is retracted from the sheet passage to a position where the front end of its surface 610 is nearly at the inclined surface 51. Consequently, the sheet S can be sent from the hopper 30 with its front end sliding on the inclined surface 51. Even if a plurality of relatively rigid sheets S are sent at the same time from the hopper 30, their front end portions are separated from each other by curving over the inclined surface 51. As a result, only the top sheet S is moved by the main feed rollers 41*a* and 41*b* so as to pass or cross the inclined surface 51.

When a large number of envelopes of the size S2 are stacked on the support 31, the load from the support 31 urged by the springs 35 can be received or born by the semi-cylindrical feed rollers 41*a,* 41*b* and 43, in spite of the height (thickness "t" in FIG. 7) of the friction members 36 from the support 31, due to the flexibility of the envelopes. Consequently, the rollers 41*a,* 41*b* and 43 can apply frictional force over the whole width of the top envelope. Accordingly, the envelope can be sent without inclining sideways. As shown in FIG. 6, one or both of right and left end portions of an envelope may be bent, curved or warped, and consequently their rigidity may be high. Even in this case, the envelope can pass the inclined surface 51 without being resisted highly because of the small friction factor of the resin sheets 52*a* and 52*b,* on which the envelope end portions slide.

When the number of envelopes stacked on the support 31 is small, the pressure with which the support 31 presses the envelopes against each of the main feed rollers 41*a* and 41*b* differs from the pressure with which the support 31 presses the auxiliary feed roller 43 due to the thickness "t" of the friction members 36 (FIG. 7). Consequently, the sending force of the auxiliary roller 43 is smaller than that of each of the main feed rollers 41*a* and 41*b*. Accordingly, the envelopes can be sent mainly by the main rollers 41*a* and 41*b*. The sending force of the auxiliary roller 43 which acts on the end portion of an envelope outside the main feed roller 41*b* is small. Even though this force is small, the envelope can pass the inclined surface 51 without inclining sideways because the low friction resin sheet 52*b* extends in the portion of the inclined surface 51 on which the envelope end portion slides.

Figure 5A:
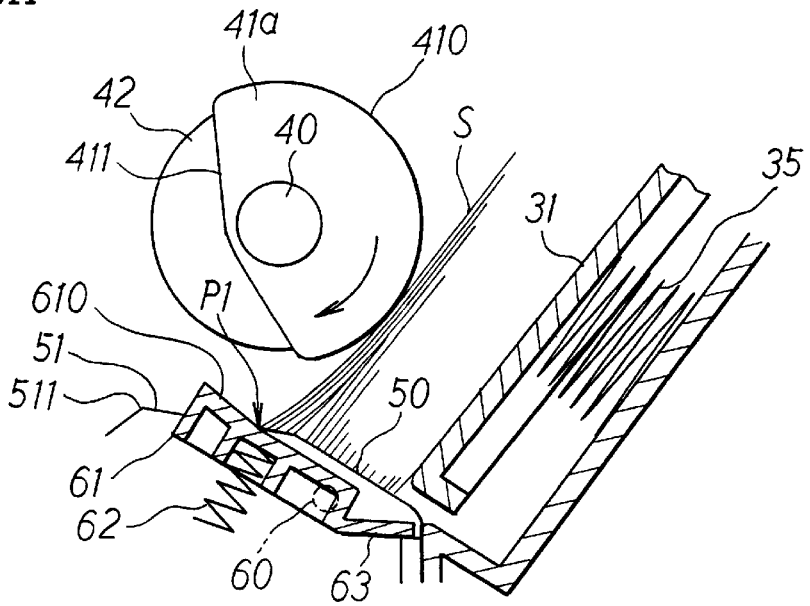
FIGS. 5A, 5B and 5C are other enlarged partial cross sections of the printer, each showing a sheet of lower rigidity being separated.
Figure 5B:
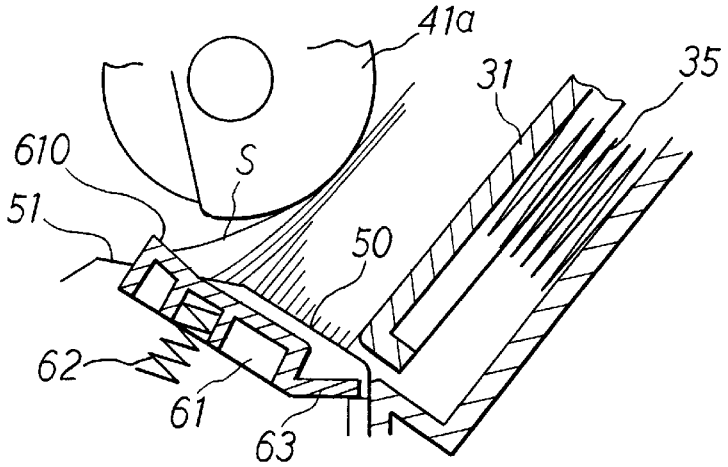
Figure 5C:
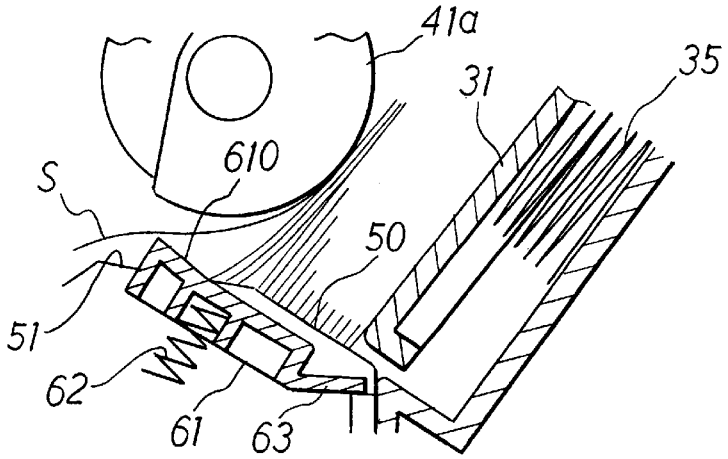

When a thin sheet of paper for business or another paper sheet S of low rigidity is forced onto the stopper 61, as shown in FIG. 5A, its rigidity is so low as to hardly compress the spring 62. Accordingly, the stopper surface 610 protrudes from the inclined surface 51. As shown in FIGS. 5B and 5C, the forced sheet S curves, passes the stopper 61 and is sent. In this case, a front end portion of the sheet S curves more than when the stopper 61 is retracted under the inclined surface 51. Consequently, even the sheet S of low rigidity is separated fully from the sheets remaining in the hopper 30, while the remaining sheets are constrained securely by the stopper 61.

Thus paper sheets S of low rigidity can be separated exclusively by the stopper 61. Therefore the inclination of the inclined surface 51 can be so set as to properly separate paper sheets S of high rigidity. This can securely separate various paper sheets independently of their rigidity.

The auxiliary feed roller 43 as well as the main feed rollers 41*a* and 41*b* acts to send paper sheets of the A4 or letter size S1, as is the case with the envelopes. Only the main feed rollers 41*a* and 41*b* send paper sheets of smaller sizes such as B5. In this case, when the sheets stacked on the support 31 are small in number, the auxiliary roller 43 idles while the main rollers 41*a* and 41*b* send the sheets because of no friction member (36) under the roller 43. If a friction member (36) was provided additionally under the roller 43, this roller would interfere with the friction member when the sheets are small in number. This would hinder the turning of the main feed rollers 41*a* and 41*b*. In accordance with this embodiment of the invention, as stated already, the sheets can be sent without hindrance.

The conveyer 7 includes, in addition to the cylindrical feed roller 70, nine driven pressure rollers 71 and three holders 72, each of which supports three of the rollers 71. The holders 72 are supported pivotably by a shaft 72*a,* which extends in parallel to the shaft 40 between the side walls 81. Formed between the passage walls 82*a* and 82*b* is a slot or opening 83, through which the cylindrical surface of the feed roller 70 is exposed partially to the sheet passage. Each holder 72 is urged by a spring 75 in such a manner that the pressure rollers 71 are in compressive contact with the exposed surface of the feed roller 70. The axes of the rollers 70 and 71 are parallel to the shaft 40.

The downstream passage wall 82*b* faces the print head 13, and inclines relative to the ejection surface of the head 13.

The tangent on the nip between the cylindrical feed roller 70 and each pressure roller 71 inclines so as to intersect the downstream passage wall 82*b*. A paper sheet fed by the rollers 70 and 71 comes into contact with the wall 82*b* obliquely from above.

The holder shaft 72*a* is positioned upstream from the pressure rollers 71. The upstream surfaces of the holders 72 and the upstream passage wall 82*a* define part of the sheet passage. Each holder 72 is fitted with two first elastic guide strips 73, which may be made of sheet metal or resin film. The rear end of each strip 73 is fixed to the upstream surface of the holder 72. The six strips 73 on the holders 72 are positioned at intervals along the axis of the cylindrical feed roller 70. A free end portion of each strip 73 is in contact with the feed roller 70, and extends under the shaft connecting the pressure rollers 71 together. The free end of each strip 73 protrudes toward the print head 13. The upstream passage wall 82*a* extends from the front end of the inclined wall 51 toward the holders 72. The wall 82*a* is fitted with second elastic guide strips 84, which may be made of sheet metal or resin film. The rear ends of the strips 84 are fixed to a front end portion of the wall 82*a*. The strips 84 are positioned at intervals along the axis of the cylindrical feed roller 70. The free ends of the strips 84 protrude from the front end of the wall 82*a* toward the holders 72.

Figure 8:
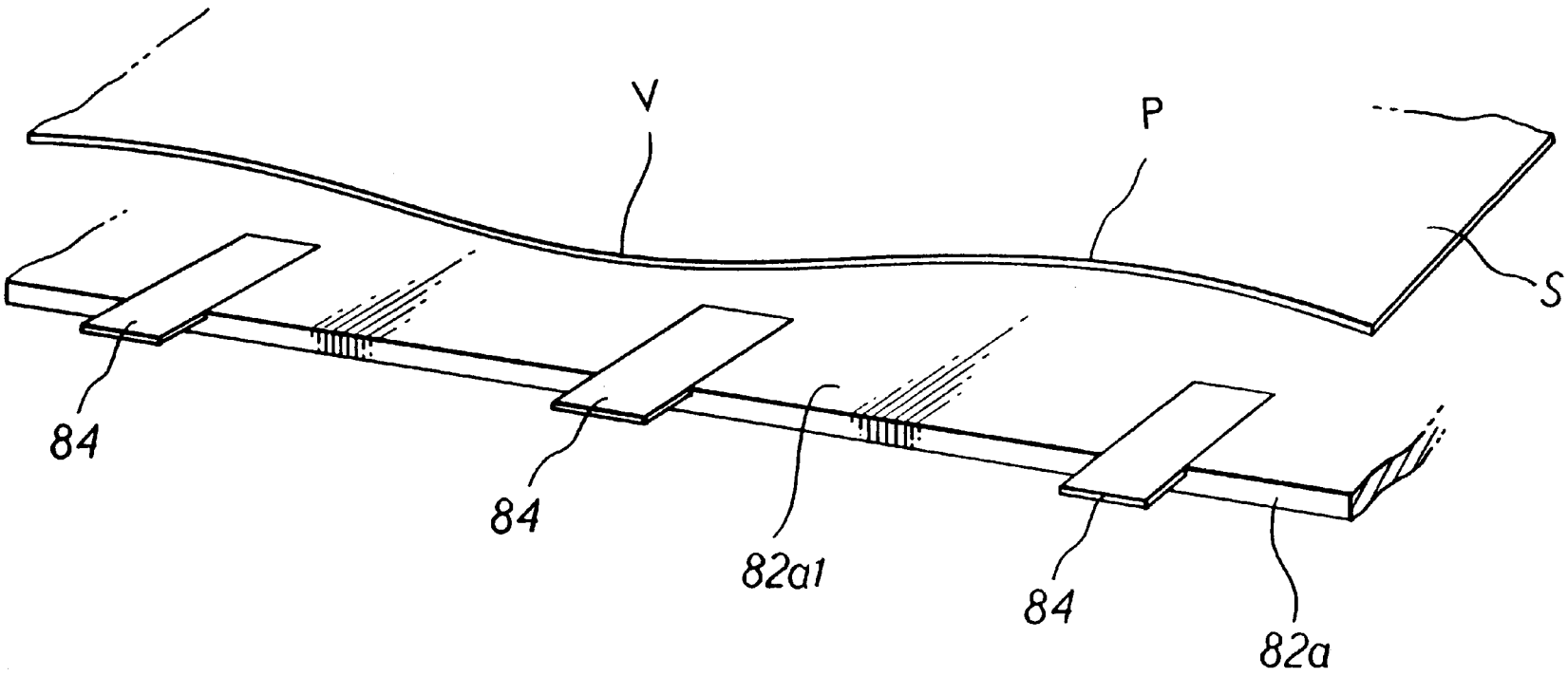
FIG. 8 is a fragmentary perspective view of the printer, showing the relationship between a sheet of paper and the second guide strips of the printer.

The front end of a sheet S sent from the hopper 30 by the main feed rollers 41*a* and 41*b* slides along the inclined surface 51, and comes into contact with the upstream surfaces of the holders 72 directly or after sliding on the passage wall 82*a*. As shown in FIG. 8, it is not avoidable that the sheet end is wavy up and down over the width of the sheet. The sheet wave has one or more valleys V and one or more peaks P. When the sheet end has come near the nips defined between the cylindrical feed roller 70 and the guide strips 73, the valleys V and peaks P meet the roller 70 at different angles. The valleys V meet the cylindrical surface of the roller 70 at larger angles than the peaks P. The deeper the valleys V are, the nearer to a right angle the angles at which they meet the roller surface are.

Without the second guide strips 84, the sheet S might be damaged by the shock caused when the wave valleys V meet the feed roller 70. In particular, the damage is serious if the valleys V meet the roller 70 turning reversely as stated below.

The wavy sheet S moves downstream along the holders 72 and first guide strips 73 while it is flattened substantially by the second guide strips 84, and reaches the nips between the cylindrical feed roller 70 and first guide strips 73. When the sheet S has just reached the nips, the roller 70 is either turning reversely (clockwise in FIG. 1) or stopping. Therefore, the sheet S is not conveyed toward the print head 13. In the meantime, the main feed rollers 41*a* and 41*b* keep turning by a predetermined angle. As a result, the sheet S curves on or over the passage wall 82*a*. The front end or edge of the curved sheet S is positioned on the nips, and its inclination is rectified. Thus, the sheet S is registered.

Thereafter, the cylindrical feed roller 70 is turned normally (counter-clockwise in FIG. 1) to feed the sheet S between it and the pressure rollers 71 until the first printing position on the sheet is under the head 13. In the meantime, the main feed rollers 41*a* and 41*b* keep turning until they return to their initial position shown in FIG. 1, where their cylindrical surfaces 410 are away from the sheets S. The rollers 41*a* and 41*b* then stop at the initial position.

Each time the print unit 1 has printed a line on a sheet S, the cylindrical feed roller 70 feeds the sheet by a predetermined amount, drawing a rear part of the sheet S from the hopper 30. In the meantime, the collars 42 are in compressive contact with the sheet S. Therefore, while the collars 42 keep the main feed rollers 41*a* and 41*b* spaced from the sheet S, the collars turn by following the sheet being drawn. Because the sheet S is urged against the collars 42 by the springs 35, the collars 42 turn with friction on the shaft 40. Accordingly, the cylindrical feed roller 70 draws the sheet S with predetermined resistance. This keeps the sheet S tense between the roller 70 and collars 42.

When the sheet S is tense, the free ends of the second guide strips 84 curve down. As stated above, it would be possible to rectify the wave of a sheet S by extending the front end of the passage wall 82*a* to a position as near as possible to the nips between the cylindrical feed roller 70 and first guide strips 73. When the sheet S is tense as stated above, however, it would turn or bend at the extended end of the wall 82*a* so sharply that the feeding is resisted, because the wall 82*a* is not parallel to the strips 73. In particular, an envelope, a post card or another sheet of higher rigidity does not easily bend, and would therefore be resisted higher.

Therefore, the front end of the passage wall 82*a* is spaced as away as possible from the nips between the cylindrical feed roller 70 and first guide strips 73. As stated above, the free ends of the second guide strips 84 are curved down (FIG. 3). This prevents a sheet S from turning or bending sharply at the front end of the wall 82*a,* and can consequently reduce the resistance.

As stated above, the springs 35 urge the support 31 toward the main feed rollers 41*a* and 41*b*. Each spring 35 is positioned near one of the friction members 36. The urging force can elastically deform the rollers 41*a* and 41*b* and the support 31. The rollers 41*a* and 41*b* can therefore receive a load from the support 31 even though their diameters differ. Due to the diameter difference, however, the roller 41*b* of the larger diameter is larger in elastic deformation and in touch area on a sheet of paper than the smaller roller 41*a*. Besides, the spring 35 adjacent to the larger roller 41*b* is larger in contraction than the spring 35 adjacent to the smaller roller 41*a*. As a result, the larger roller 41*b* is larger in gripping or sending force for a sheet of paper than the smaller roller 41*a*. Furthermore, the larger roller 41*b* can send or feed a more amount than the smaller roller 41*a*. Therefore, when an envelope is set on the support 31 with sheets of paper put between them, the part of the envelope which extends between the roller 41*b* and the movable guide 37 can be sent with sufficient force against the resistance of the top sheet or the inclined surface 51 to the envelope. Accordingly, the side of the envelope which is adjacent to the movable guide 37 can be sent without moving behind the other side, that is to say, without the envelope inclining with respect to the sending direction. Besides, the existence of the low friction sheet 52*b* accelerates the smooth sending of the envelope side adjacent to the movable guide 37.

When the conveyer 7 registers a relatively rigid sheet of paper such as an envelope, which does not easily curve, it is not easy to rectify inclination of the sheet by curving the sheet. Because the sheet is relatively rigid, however, the main feed rollers 41*a* and 41*b* can slip on the sheet being registered. Therefore, the sheet can be registered by the conveyer 7. Although the rollers 41*a* and 41*b* send different amounts, the conveyer 7 can register the sheet because the rollers 41*a* and 41*b* slip by different amounts on the sheet being registered.

The main feed rollers 41*a* and 41*b* contribute toward sending sheets of paper for business which are smaller than the size S1. In this case, a sheet is sent as it is inclined with respect to the sending direction because the rollers 41*a* and 41*b* send different amounts. However, when a sheet of low rigidity is registered by the conveyer 7, the sheet curves sufficiently to rectify the inclination of its front end and register itself securely.

In this embodiment, the main feed roller 41*b* can send a more amount and is larger in sending force than the roller 41*a*. However, only one of the sending amount and force of the roller 41*b* might be larger than that of the roller 41*a*. In order to increase the sending force, the frictional force of the rubber of which the roller 41*b* is made with respect to a sheet of paper may be larger than that of the roller 41*a*. Otherwise, the roller 41*b* may be larger axially than the roller 41*a*. Still otherwise, the spring 35 adjacent to the roller 41*b* may be larger in spring constant than the spring 35 adjacent to the roller 41*a*. In this embodiment, the main feed rollers are two in number. In this invention, however, three or more main feed rollers may be provided.

Figure 9:
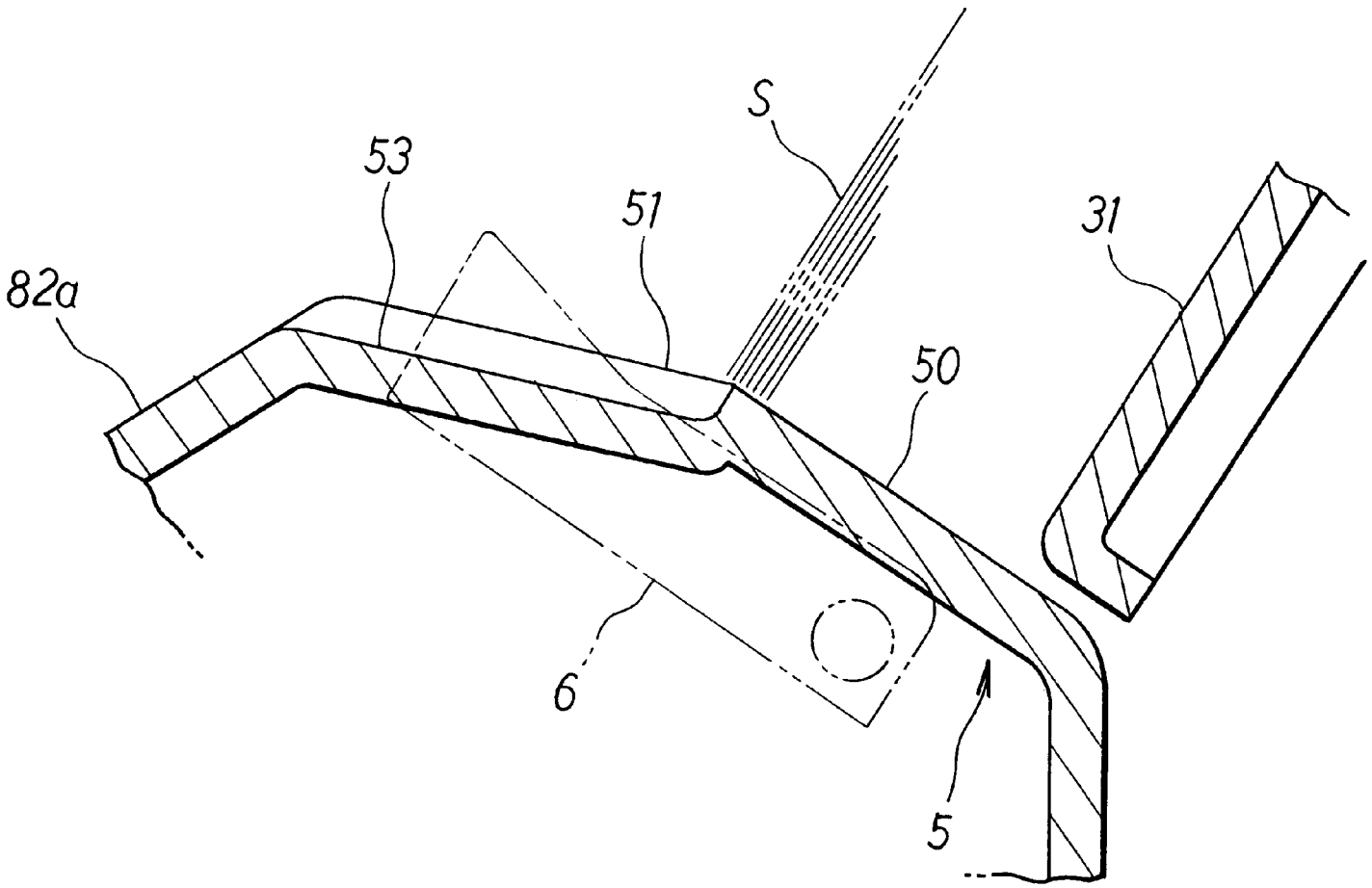
FIG. 9 is a partial cross section of an ink jet printer according to another of the embodiments, showing a modification of the wall 5.

In this embodiment, the resin sheets 52*a* and 52*b* of the small friction factors are stuck to the inclined surface 51. Instead, however, when the wall 5 is formed out of resin, only those parts of the surface 51 where the resin sheets would otherwise exist might be smooth to be less resistant. Otherwise, as shown in FIG. 9, the inclined surface 51 of another embodiment has recesses 53 formed in the positions where the resin sheets would otherwise exist. This prevents the right and left edges of a paper sheet from contacting the inclined surface 51 so that the sheet is less resisted.

In accordance with the sizes and friction factors of the less resistant surfaces, the auxiliary feed roller 43 could be omitted.

The friction members 36 are higher than the upper surface of the support 31. Instead, however, this surface of the support 31 might differ in height between its part adjacent to the main feed rollers 41 and its part adjacent to the auxiliary feed roller 43. The friction members 36 might be embedded or fitted in the higher part of the surface in such a manner that their upper surfaces are flush substantially with this part.

A sheet feeder according to the invention can be applied to, not only ink jet printers, but also laser printers, copying machines, facsimile machines and other printers. The invention may be applied to even sheet feeders where sheets of paper are held horizontally.

What is claimed is:

1. A sheet feeder comprising:

a sheet support on which sheets of paper can be stacked with their front ends aligned on a bottom surface of the support;

a feed roller for feeding one by one the sheets stacked on the support; and an inclined surface extending from a front end of the bottom surface of the support downstream in a feeding direction, the inclined surface inclining downstream with respect to the bottom surface;

the inclined surface including two side end portions which extend in the feeding direction, at least one of the side portions being less resistant to the sheets than a portion of the inclined surface which faces the feed roller.

2. The sheet feeder of claim 1, wherein the feed roller is positioned out of symmetry with respect to the width of the bottom surface of the sheet support, one of the side end portions of the inclined surface being farther from the roller than the other, the farther side end portion being less resistant to the sheets than the portion of the inclined surface which faces the roller.

3. The sheet feeder of claim 2, wherein the feed roller includes at least two rollers.

4. The sheet feeder of claim 2, wherein both of the side end portions of the inclined surface are less resistant to the sheets than the portion facing the roller, the farther side end portion being larger in area than the other side end portion.

5. The sheet feeder of claim 1, wherein at least one of the side end portions of the inclined surface is less resistant to the sheets than the portion of the inclined surface which faces the roller by forming a smooth film on the at least one of the side end portions.

6. The sheet feeder of claim 4, wherein at least one of the side end portions of the inclined surface is less resistant to the sheets than the portion of the inclined surface which faces the roller by forming a smooth film on the at least one of the side end portions.

7. The sheet feeder of claim 1, wherein the at least one of the side end portions of the inclined surface is less resistant to the sheets than the portion of the inclined surface which faces the roller by forming a recess on the at least one of the side end portions.

8. The sheet feeder of claim 2, wherein the sheet support includes a reference guide for contacting and registering the adjacent side edges of the stacked sheets, the feed roller being offset toward the guide widthwise of the sheets.

9. A printer comprising:

a sheet support on which sheets of paper can be stacked with their front ends aligned on a bottom surface of the support;

a feed roller for feeding one by one the sheets stacked on the support;

an inclined surface extending from a front end of the bottom surface of the support downstream in a feeding direction, the inclined surface inclining downstream with respect to the bottom surface, the inclined surface including two side end portions which extend in the feeding direction, at least one of the side end portions being less resistant to the sheets than a portion of the inclined surface which faces the feed roller; and a print head positioned downstream from the inclined surface.

10. A sheet feeder for feeding at least sheets of a first size and sheets of a second size narrower than the first size the sheet feeder comprising:

a sheet support;

a feed roller for feeding one by one sheets of paper stacked on the sheet support, which urges the sheets toward the feed roller;

a reference guide for contacting and registering adjacent first side edges of the stacked sheets; and an auxiliary roller supported coaxially with and spaced from the feed roller, which is positioned between the auxiliary roller and the reference guide, the auxiliary roller being positioned so as to engage sheets of the first size during feeding by the feed roller and to not engage sheets of the second size during feeding by the feed roller;

a friction member fixed to a portion of the support which faces the feed roller, the friction member being higher than a portion of the surface of the support which faces the auxiliary roller.

11. The sheet feeder of claim 10, wherein, when a sheet of paper of a first size is set on the sheet support and registered by the reference guide, the feed roller faces the sheet while the auxiliary roller substantially faces a second side edge of the sheet.

12. The sheet feeder of claim 11, wherein, when an envelope sized for the sheet of paper of the first size is set on the sheet support and a first longitudinal end of the envelope is registered by the reference guide, the auxiliary roller substantially faces a second longitudinal end of the envelope.

13. The sheet feeder of claim 10, wherein the feed roller includes at least two rollers supported coaxially.

14. The sheet feeder of claim 10, wherein the sheet support has a bottom surface, on which front ends of the stacked sheets are aligned and held;

the feeder further comprising an inclined surface extending from a front end of the bottom surface of the support downstream in a feeding direction, the inclined surface inclining downstream with respect to the bottom surface, the inclined surface including two side end portions which extend in the feeding direction, at least one of the side end portions being less resistant to the sheets than a portion of the inclined surface which faces the feed roller.

15. The sheet feeder of claim 14, wherein the feed roller is positioned out of symmetry with respect to the width of the bottom surface of the sheet support, one of the side end portions of the inclined surface being farther from the reference guide than the other side end portion, the farther side end portion being less resistant to the sheets than the portion of the inclined surface which faces the feed roller.

16. The sheet feeder of claim 15, wherein at least one of the side end portions of the inclined surface is less resistant to the sheets than the portion of the inclined surface which faces the roller by forming a smooth film on the at least one of the side end portions.

17. The sheet feeder of claim 14, wherein at least one of the side end portions of the inclined surface is less resistant to the sheets than the portion of the inclined surface which faces the roller by forming a smooth film on the at least one of the side end portions.

18. A printer for printing on at least sheets of a first size and sheets of a second size narrower than the first size, the printer comprising:

a sheet support;

a feed roller for feeding one by one sheets of paper stacked on the support, which urges the sheets toward the feed roller;

a reference guide for contacting and registering adjacent side edges of the stacked sheets;

an auxiliary roller supported coaxially with and spaced from the feed roller, which is positioned between the auxiliary roller and the reference guide, the auxiliary roller being positioned so as to engage sheets of the first size during feeding by the feed roller and to not engage sheets of the second size during feeding by the feed roller;

a friction member fixed to a portion of the support which faces the feed roller, the friction member being higher than a portion of the surface of the support which faces the auxiliary roller; and a print head positioned downstream from the feed roller.

19. The printer of claim 18, wherein the sheet support has a bottom surface, on which front ends of the stacked sheets are aligned and held;

the printer further comprising an inclined surface extending from a front end of the bottom surface of the support downstream in a feeding direction, the inclined surface inclining downstream with respect to the bottom surface, the inclined surface including two side end portions which extend in the feeding direction, at least one of the side end portions being less resistant to the sheets than a portion of the inclined surface which faces the feed roller.

20. A sheet feeder comprising:

a sheet support on which sheets of paper can be stacked;

a reference guide fitted on the support for contacting and registering adjacent side edges of the sheets stacked on the support; and at least two feed rollers supported widthwise of the stacked sheets for feeding the sheets one by one, the rollers including a first feed roller and a second feed roller, the second feed roller being farther from the reference guide than the first feed roller;

the second feed roller being larger in at least one of feeding force and feeding amount than the first feed roller.

21. The sheet feeder of claim 20, wherein the feed rollers are offset toward the reference guide widthwise of the sheet support.

22. The sheet feeder of claim 21, wherein the second feed roller is larger in feeding force and feeding amount than the first feed roller.

23. The sheet feeder of claim 22, wherein the second feed roller is larger in diameter than the first roller.

24. The sheet feeder of claim 20, further comprising a registering mechanism for registering a front end of a sheet of paper fed by the feed rollers.

25. The sheet feeder of claim 24, wherein the registering mechanism comprises:

a feeding roller positioned downstream from the feed rollers and drivable in both forward and reverse directions; and a pressure roller that cooperates with the feeding roller to feed the sheet further downstream;

the registering mechanism registering the front end of the sheet fed by the feed rollers, by holding the sheet end in the vicinity of a nip between the pressure roller and the feeding roller turning reversely or stopping.

26. The sheet feeder of claim 20, wherein the sheet support includes an urging member for urging toward the feed rollers the sheets stacked on the support.

27. The sheet feeder of claim 20, wherein the sheet support has a bottom surface, on which front ends of the stacked sheets are aligned and held;

the feeder further comprising an inclined surface extending from a front end of the bottom surface of the support downstream in a feeding direction, the inclined surface inclining downstream with respect to the bottom surface, the inclined surface including two side end portions which extend in the feeding direction, at least one of the end portions being less resistant to the sheets than portions of the inclined surface which face the feed rollers.

28. The sheet feeder of claim 27, wherein the feed rollers are positioned out of symmetry with respect to the width of the bottom surface of the sheet support, one of the side end portion of the inclined surface being farther from the reference guide than the other side end portion, the farther side end portion being less resistant to the sheets than the portions of the inclined surface which face the feed rollers.

29. The sheet feeder of claim 28, wherein at least one of the side end portions of the inclined surface is less resistant to the sheets than the portions of the inclined surface which face the rollers by forming a smooth film on the at least one of the side end portions.

30. The sheet feeder of claim 27, wherein at least one of the side end portions of the inclined surface is less resistant to the sheets than the portions of the inclined surface which face the rollers by forming a smooth film on the at least one of the side end portions.

31. The sheet feeder of claim 20, further comprising:

an auxiliary roller supported coaxially with and spaced from the feed rollers, which are positioned between the auxiliary roller and the reference guide; and friction members each fixed to a portion of the sheet support which faces one of the feed rollers, the friction members being higher than a portion of the surface of the support which faces the auxiliary roller.

32. The sheet feeder of claim 27, further comprising:

an auxiliary roller supported coaxially with and spaced from the feed rollers, which are positioned between the auxiliary roller and the reference guide; and friction members each fixed to a portion of the sheet support which faces one of the feed rollers, the friction members being higher than a portion of the surface of the support which faces the auxiliary roller.

33. The sheet feeder of claim 20, further comprising a plurality of collars rotatably supported coaxially with the feed rollers;

the feed rollers being positioned substantially in lateral symmetry with respect to a lateral middle of a sheet of paper of a predetermined width;

the collars being positioned substantially at a regular interval or regular intervals over a distance longer than the predetermined width widthwise of the sheet.

34. A printer comprising:

a sheet support on which sheets of paper can be stacked;

a reference guide fitted on the support for contacting and registering adjacent side edges of the sheets stacked on the support;

at least two feed rollers supported widthwise of the stacked sheets for feeding the sheets one by one, the rollers including a first feed roller and a second feed roller, the second feed roller being farther from the reference guide than the first roller, the second feed roller being larger in at least one of feeding force and feeding amount than the first feed roller; and a print head positioned downstream from the feed rollers.

35. The printer of claim 34, wherein the sheet support has a bottom surface, on which the front ends of the stacked sheets are aligned and held;

the printer further comprising an inclined surface extending from the front end of the bottom surface of the support downstream in the feeding direction, the inclined surface inclining downstream with respect to the bottom surface, the inclined surface including both side end portions which extend in the feeding direction, at least one of the end portions being less resistant to the sheets than portions of the inclined surface which face the feed rollers.

36. The printer of claim 34, further comprising:

an auxiliary roller supported coaxially with and spaced from the feed rollers, which are positioned between the auxiliary roller and the reference guide; and friction members each fixed to a portion of the sheet support which faces one of the feed rollers, the friction members being higher than a portion of the surface of the sheet support which faces the auxiliary roller.

37. The printer of claim 35, further comprising:

an auxiliary roller supported coaxially with and spaced from the feed rollers, which are positioned between the auxiliary roller and the reference guide; and friction members each fixed to a portion of the sheet support which faces one of the feed rollers, the friction members being higher than a portion of the surface of the sheet support which faces the auxiliary roller.

38. The printer of claim 37, further comprising a registering mechanism for registering a front end of a sheet of paper fed by the feed rollers.

39. The printer of claim 9, which is an ink jet printer.

40. The printer of claim 19, which is an ink jet printer.

41. The printer of claim 34, which is an ink jet printer.

* * * * *